United States Patent [19]

Collier

[11] Patent Number: 4,534,045

[45] Date of Patent: Aug. 6, 1985

[54] DEVICE FOR RECORDING HOST ELECTRONIC INSTRUMENT OPERATING ON-TIME

[75] Inventor: Warren Collier, Beaverton, Oreg.

[73] Assignee: Tektronix, Inc., Beaverton, Oreg.

[21] Appl. No.: 555,745

[22] Filed: Nov. 28, 1983

[51] Int. Cl.[3] ..... G07C 3/04

[52] U.S. Cl. ..... 377/16; 377/2; 377/20; 324/76 R; 324/157; 324/142

[58] Field of Search ..... 377/15, 16, 2, 20; 324/76 R, 142, 157

[56] References Cited

U.S. PATENT DOCUMENTS

| | | | |
|---|---|---|---|
| 3,939,361 | 2/1976 | Aldala et al. | 377/2 |
| 4,080,568 | 3/1978 | Funk | 324/142 |
| 4,165,485 | 8/1979 | Takahashi | 324/142 |
| 4,180,724 | 12/1979 | Councilman et al. | 377/16 |
| 4,261,037 | 4/1981 | Hicks | 324/142 |
| 4,463,354 | 7/1984 | Sear | 324/157 |

*Primary Examiner*—John S. Heyman

*Attorney, Agent, or Firm*—John Smith-Hill

[57] ABSTRACT

The instrument operating time recorder (10) is attached to host instrument (12) and includes a frequency divider (14) for counting line voltage transitions during power-on time and to generate a binary output for a prescaler (20). Prescaler (20) divides by a predetermined value set to the frequency of the host instrument and generates a signal for a digital decoder (24) the output of which can be applied to the readout or display (26).

5 Claims, 1 Drawing Figure

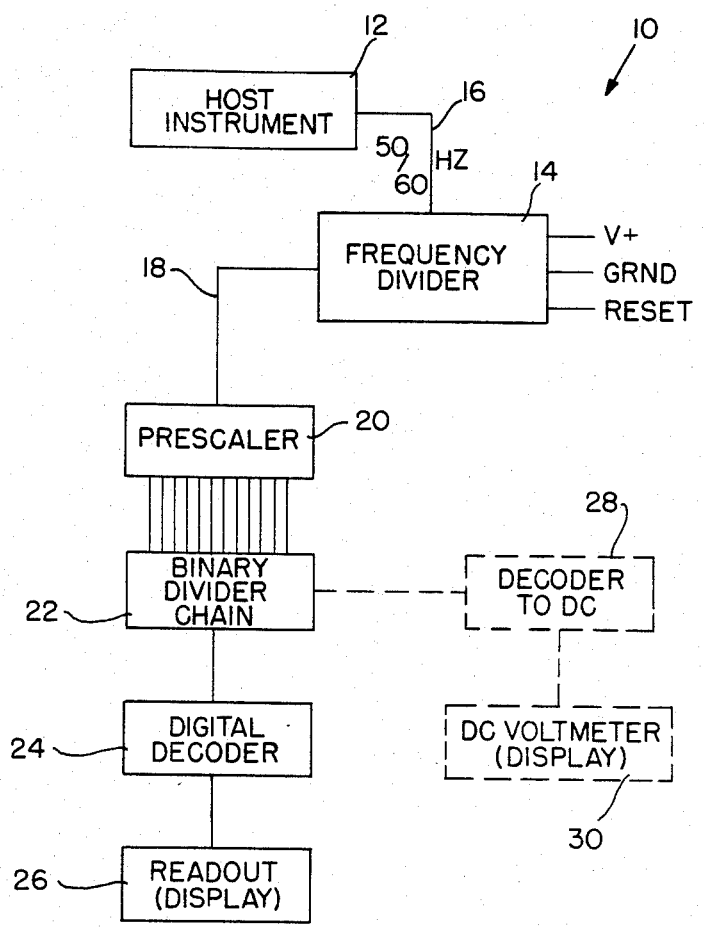
12
10
HOST INSTRUMENT
16
50
60
HZ
14
FREQUENCY DIVIDER
V+
GRND
RESET
18
PRESCALER
20
28
BINARY DIVIDER CHAIN
22
DECODER TO DC
DIGITAL DECODER
24
DC VOLTMETER (DISPLAY)
30
READOUT (DISPLAY)
26

DEVICE FOR RECORDING HOST ELECTRONIC INSTRUMENT OPERATING ON-TIME

DESCRIPTION

1. Technical Field

This invention relates to the art of recorders for the period of time a host electronic instrument has spent in actual operation during a given period of calendar time.

2. Background of the Invention

As those skilled in the art are aware, there are well established reasons for wanting to know the amount of time an electronic instrument has been operating through a calendar period. Included in these reasons are reliability studies, preventive maintenance scheduling, calibration scheduling and utilization/economic studies with respect to the instrument.

There are two major techniques which have been and currently are being used for recording power-on time. The more common form of running-time meter contains a clock-type motor which drives a display similar to an automobile odometer. This type of unit is generally rather large but may be panel mounted, particularly in a system installation or on a large piece of equipment.

Another device which has been developed and which is aimed at internal installation in instruments is an analog device. In such analog devices, current from a DC power supply is used to plate metal across a gap in a glass tube. It is read in a manner similar to reading a liquid, glass tube thermometer. The metal ion deposition is in direct proportion to the amount of DC current flow in the host instrument.

Experience with known devices has shown that they have limited range, usually within the 1,000 to 2,000 hour range, poor resolution and readability, and generally poor reliability.

SUMMARY OF THE INVENTION

The device of this invention connects to a host electronic instrument to meter or record the instrument's on-time by utilizing a frequency divider to generate appropriate binary output signals and a prescaler to set the resolution to a time value which is convenient. The prescaler signal is then changed to a digital number and from there the digital output can be decoded to a display or other readout.

DESCRIPTION OF THE DRAWING

The FIGURE is a block diagram of the primary electronic circuit components for the invention.

BEST MODE FOR CARRYING OUT THE INVENTION

The present invention generally referred to by the number 10 and utilizing logic components can be conveniently connected to a host electronic instrument for readout and/or display at any convenient location. The primary component is a frequency divider chip or counter IC 14 with 16 pins. One pin will receive frequency input from the host instrument via line 16. Three other pins will be devoted to battery, ground/-common, and reset. The other 12 pins will be allocated to the binary output signals. It will be appreciated that the frequency divider 14 counts line voltage transitions during power-on time and that the binary divider chain generates a binary number output.

Prescaler 20 allows basic resolution of the host instrument on time to be set to some convenient value which can be in the range of from a fraction of an hour to several hours. As an example, a one hour resolution will have the prescaler divide by 3600 so that there is an output transition once each hour when the input signal has a value of 60 Hz. For a 50 Hz output from the host instrument a divide by 3000 prescaler could be used. Assuming the output is scaled to one hour, the capacity of the device would be 8,191 hours, compared to a full year which is 8,660 continuous hours. It will be understood that range and resolution may be balanced with respect to each other by changing the prescale factor. Obviously, range can be significantly increased independently of resolution by using an 18 pin counter IC.

The prescaler directs its signal to a binary divider chain 22 or series of flip flops to generate a digital output for decoder 24. Decoder 24 signals are then sent to readout or display 26 which in turn displays the number of hours of on-time applied to host instrument 12.

The instant system will use a special purpose external decoder 24 to translate the counter IC's output into a digital display. The external readout or display device will be a relatively simple and low cost item and in a number of applications only one or two of the inventive devices would be required at any facility needing such devices.

It should be noted that as an alternative it is feasible with a decoder 28 to generate a DC voltage proportional to the time value. This would allow readout at display 30 with an ordinary direct voltage meter.

Aside from the frequency divider IC and battery, the host system could include a zener diode and resistor for shaping the 50 Hz or 60 Hz input signal though it is contemplated that these may be incorporated in the IC itself.

I claim:

1. Device for host electronic instrument operating time recording, comprising:

a frequency divider circuit means for counting line voltage transitions during power-on time of said host instrument and for generating binary number signals, a prescaler circuit means for receiving said binary number signals and dividing said binary number signals by a predetermined numerical value to establish a reduced time resolution for the power-on time of said host instrument, binary divider chain circuit means which receives the prescaled output signal from said prescaler and generates a digital number output, and display means for receiving said digital number output for visual readout of the power-on time of said host instrument.

2. The device according to claim 1 and in which a digital decoder circuit means is disposed between said binary divider chain and said display means.

3. The device according to claim 1 and in which a decoder circuit means receives said digital number output from said binary divider chain and generates a direct current voltage proportional to said power-on time and outputs said proportional voltage to a display means.

4. The device of claim 1 and in which said prescaler circuit means is set to divide said binary number signals by 3600.

5. The device according to claim 1 and in which said prescaler circuit means is set to divide said binary number signals by 3000.

* * * * *